United States Patent [19]

Tanaka

[11] Patent Number: 4,557,370

[45] Date of Patent: Dec. 10, 1985

[54] FINGER APPARATUS FOR AN IDLE STATION IN A TRANSFER PRESS

[75] Inventor: Toshihiro Tanaka, Komatsu, Japan

[73] Assignee: Kabushiki Kaisha Komatsu Seisakusho, Tokyo, Japan

[21] Appl. No.: 590,300

[22] Filed: Mar. 14, 1984

[30] Foreign Application Priority Data

Mar. 14, 1983 [JP] Japan ..... 58-35394[U]

[51] Int. Cl.[4] ..... B65G 25/00

[52] U.S. Cl. ..... 198/621; 198/774; 72/405; 414/751; 414/917

[58] Field of Search ..... 198/621, 648, 583, 584, 198/774; 414/750, 751, 222, 225, 917; 72/405

[56] References Cited

U.S. PATENT DOCUMENTS

| | | | |
|---|---|---|---|
| 3,939,992 | 2/1976 | Mikulec | 198/621 X |
| 4,051,955 | 10/1977 | Kaffka | 198/774 X |
| 4,311,429 | 1/1982 | Wallis | 198/621 X |
| 4,503,969 | 3/1985 | Baba | 198/621 |

*Primary Examiner*—Joseph E. Valenza
*Assistant Examiner*—Jonathan D. Holmes
*Attorney, Agent, or Firm*—Armstrong, Nikaido, Marmelstein & Kubovcik

[57] ABSTRACT

A finger apparatus for an idle station of a transfer press including a pair of transfer bars each divided into an upstream side end bar, a central bar and a downstream side end bar. The central bar is adapted to be moved in and out of the press together with a moving bolster and the end bars are positioned between uprights of the press. A finger of the apparatus is mounted to a mounting plate which is connected to the central bar via quadric linkage. A cylinder is connected to the quadric linkage and the central bar for swinging the mounting plate between a first position where the mounting plate is abutted on the upper surface of the upstream side end bar and/or the downstream side end bar and a second position where the mounting plate is held above the central bar such that the finger may be moved in and out of the transfer press with the mounting bolster.

2 Claims, 3 Drawing Figures

FINGER APPARATUS FOR AN IDLE STATION IN A TRANSFER PRESS

BACKGROUND OF THE INVENTION

This invention relates to a finger device for an idle station in a transfer press.

In a transfer press including transfer bars each divided into three portions consisting of an upstream side end bar, a central bar and a downstream side end bar, the upstream side end bar and downstream side end bar are located between uprights, and the central bar is located at a position above a moving bolster. A plurality of fingers for transfer are mounted on the central bar, and a single finger for an idle station is mounted on either one or both of the upstream side end bar and downstream side end bar, respectively. The central bar can be carried out and carried in together with the moving bolster with respect to the main body of the press. Therefore, the fingers mounted on the central bar can be easily replaced at the outside of the main body. However, since the conventional fingers for the idle station were mounted on the upstream side end bar and downstream side end bar, workers must have entered into the main body of the press for replacement. Consequently, the replacement work of the fingers of these particular portions was inefficient and risky.

SUMMARY OF THE INVENTION

It is therefore an object of the present invention to provide a finger apparatus for an idle station of a transfer press which overcomes the above noted problem of the prior art.

Another object of the present invention is to provide a finger apparatus for an idle station of a transfer press wherein a finger for the idle station is mounted to a central bar via a quadric linkage and is adapted to be moved in and out of the press together with a moving bolster when held in a raised position.

In accordance with an aspect of the present invention, there is provided a finger apparatus for an idle station of a transfer press including a pair of transfer bars each comprising an upstream side end bar, a central bar and a downstream side end bar detachably interconnected with each other and a moving bolster, said central bar being adapted to be moved in and out of said press together with said moving bolster, said transfer press having at least one idle station provided therein, said finger apparatus, comprising: a finger; a mounting plate having said finger mounted thereto; a quadric linkage connected at one end thereof to said mounting plate and at the other end to said central bar; and cylinder means having one end connected to said linkage and the other end connected to said central bar for moving said mounting plate between a first position where said mounting plate is abutted on the upper surface of one of said end bars and a second position where said mounting plate is held above said central bar.

The above and other objects, features and advantages of the present invention will be readily apparent fom the following description taken in conjunction with the accompanying drawings.

DESCRIPTION OF THE PREFERRED EMBODIMENT

A preferred embodiment of the present invention will be described in detail with reference to the accompanying drawings.

Figure 1:
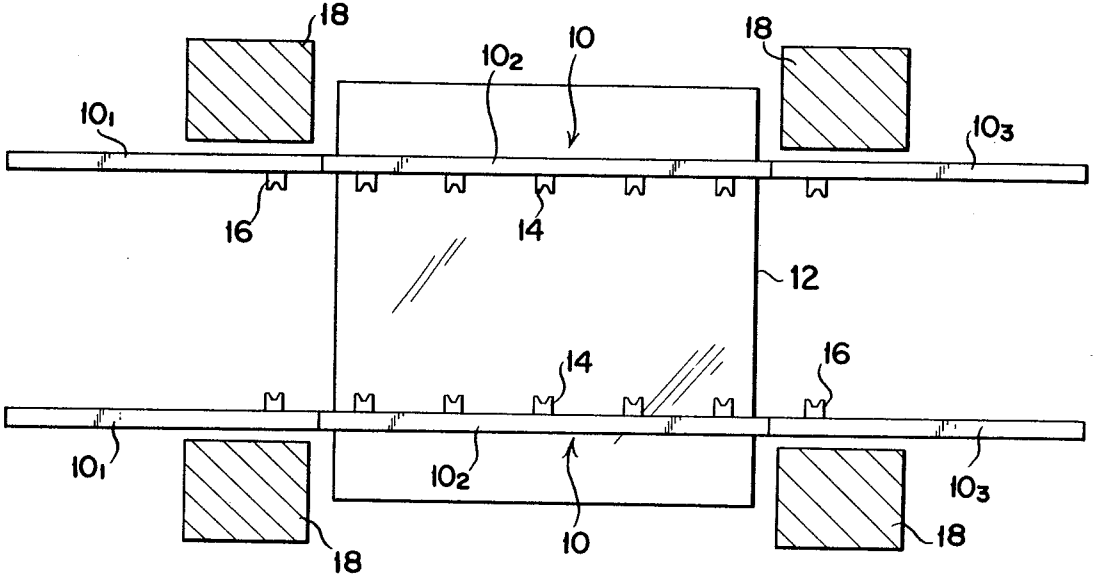
FIG. 1 is a schematic plan view, partly in section, showing the arrangement of transfer bars and a moving bolster to which a finger apparatus of the present invention is applied.

Referring to FIG. 1, numeral 10 denotes a pair of transfer bars. Each of the transfer bars 10 is divided into three portions consisting of an upstream side end bar $\mathbf{10_1}$ positioned at an entrance side of a workpiece, a central bar $\mathbf{10_2}$ positioned above a moving bolster 12 and a downstream side end bar $\mathbf{10_3}$ positioned at an exit side of the workpiece and detachably interconnected. A plurality of finger 14 for transfer are mounted on the central bar $\mathbf{10_2}$. Fingers 16 for the idle station are mounted one each on the upstream side end bar $\mathbf{10_1}$ and downstream side end bar $\mathbf{10_3}$, respectively. Numeral 18 denotes uprights for the transfer press.

Figure 2:
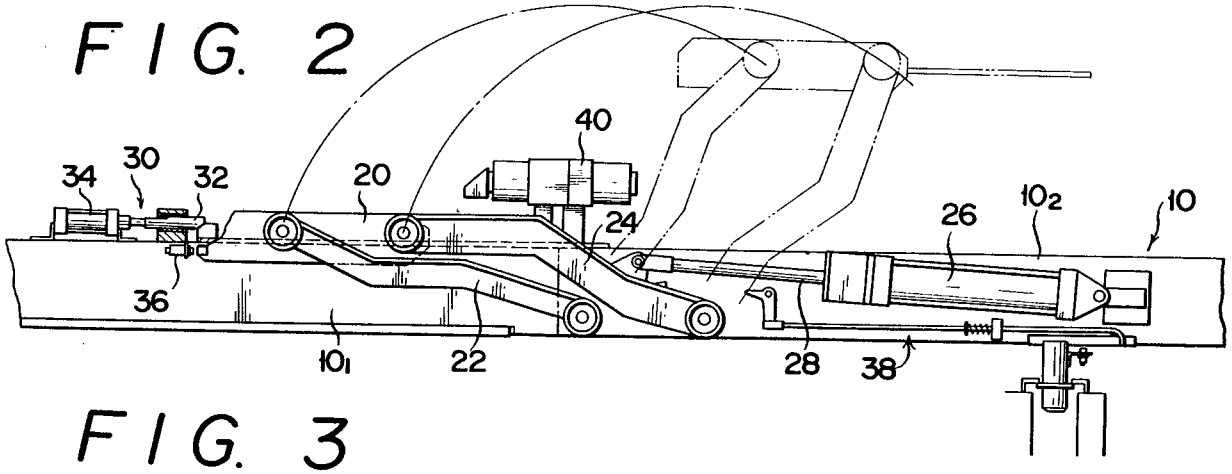
FIG. 2 is a front elevational view of a finger apparatus of the present invention.
Figure 3:
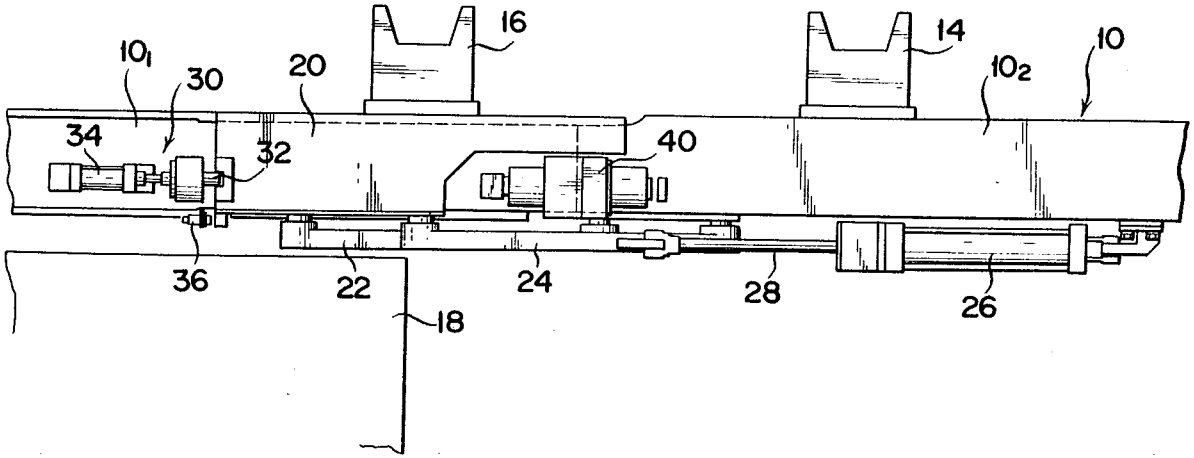
FIG. 3 is a top plan view thereof.

Referring to FIGS. 2 and 3, one of said fingers 16 for the idle station is fixedly secured to a plate 20 abutted with said upstream side end bar 10. Said plate 20 is connected at its one side to one side of the end portion of said central bar $\mathbf{10_2}$ by means of quadric links 22 and 24. Numeral 26 denotes a cylinder device pivotally mounted at its one end to one side of said central bar $\mathbf{10_2}$. A piston rod 28 of said cylinder device 26 is connected to one of said quadric links 22 and 24 in such a manner that said plate 20 is moved to a position above said central bar $\mathbf{10_2}$ from its initial position lying along the upper surface of said upstream side end bar $\mathbf{10_1}$ by means of telescopic motion of said cylinder device 26.

Numeral 30 denotes a lock device for locking said plate 20 into said upstream side end bar $\mathbf{10_1}$, said lock device being mounted on said upstream side end bar $\mathbf{10_1}$ and comprising a nail 32 and a cylinder device 34 for activating said nail 32 forwardly and backwardly. Numeral 36 is a detector detecting that said plate 20 is on the upstream side end bar $\mathbf{10_1}$, and numeral 38 is another detector detecting that said quadric links 22 and 24 are pivotally lifted upwards.

Numeral 40 denotes a connector device for connecting electric and air compression sources between said upstream side end bar $\mathbf{10_1}$, and central bar $\mathbf{10_2}$ and dividable at the dividing surfaces of said upstream side end bar $\mathbf{10_1}$ and central bar $\mathbf{10_2}$.

Said cylinder device 26 for pivotally actuating said quadric links 22 and 24 is locked when the air supply is stopped.

In FIGS. 2 and 3, although an embodiment is shown wherein the idle station is located at the side of said upstream side end bar $\mathbf{10_1}$, it may be located at the side of said downstream side end bar $\mathbf{10_3}$ as well.

With the above described structure, the bolster is carried out of the press in such a manner as that firstly said lock device 30 is unlocked and thereafter said cylinder device 26 is retracted to lift said plate 20 upwards. By this, the one of the fingers 16 for the idle station including said plate 20 is pivotally moved to a position above said central bar $\mathbf{10_2}$ where said one of the fingers 16 is not interfered by said uprights, with respect to the moving direction of said bolster 12.

When said bolster 12 is moved out of the main body of the press in the above state, said one of the fingers 16 for the idle station is also carried out of the main body of the press together with said central bar $10_2$.

Since the present invention functions in a way as described above, said one of the fingers 16 for the idle station can be carried out of the main body of the press together with the central bar $10_2$ by means of said moving bolster 12 and the replacement work thereof can be conducted at the outside of the main body of the press safely and efficiently. Furthermore, according to the present invention, said fingers 14 mounted on the central bar $10_2$ are not interfered by said one of the fingers 16 for the idle station, because the latter is moved approximately in parallel towards a position above said central bar $10_2$ by means of said quadric links 22 and 24. Furthermore, since said one of the fingers 16 for the idle station is connected to said central bar $10_2$ by means of said quadric links 22 and 24, a simple structure for pivotally moving said one of the fingers 16 for the idle station is obtainable.

What is claimed is:

1. In a transfer press including a pair of transfer bars each comprising an upstream side end bar, a central bar and a downstream side end bar detachably interconnected with each other and a moving bolster, said central bar being adapted to be moved in and out of said press together with said moving bolster, said transfer press having at least one idle station provided therein, a finger apparatus for the idle station, the improvement comprising:

a finger;

a mounting plate having said finger mounted thereto;

a quadric linkage connected at one end thereof to said mounting plate and at the other end to said central bar; and cylinder means having one end connected to said linkage and the other end connected to said central bar for moving said mounting plate between a first position where said mounting plate is abutted on the upper surface of one of said end bars and a second position where said mounting plate is held above said central bar such that said finger may be moved in and out of said transfer press with said moving bolster.

2. A finger apparatus according to claim 1 further comprising locking means for locking said mounting plate to the first position.

* * * * *